US005327917A

United States Patent [19]

Lekwauwa et al.

[11] Patent Number: 5,327,917

[45] Date of Patent: Jul. 12, 1994

[54] METHOD FOR PROVIDING A RECONSTITUTED TOBACCO MATERIAL

[75] Inventors: Aju N. Lekwauwa; Walter R. D. Young, Jr., both of Winston-Salem, N.C.

[73] Assignee: R. J. Reynolds Tobacco Company, Winston-Salem, N.C.

[21] Appl. No.: 931,249

[22] Filed: Aug. 17, 1992

Related U.S. Application Data

[63] Continuation-in-part of Ser. No. 800,679, Nov. 27, 1991, which is a continuation-in-part of Ser. No. 567,519, Aug. 15, 1990, Pat. No. 5,101,839.

[51] Int. Cl.[5] ..... A24B 3/14; A24B 15/24

[52] U.S. Cl. ..... 131/370; 131/297; 131/372

[58] Field of Search ..... 131/370, 372-375, 131/297, 298

[56] References Cited

U.S. PATENT DOCUMENTS

| | | | |
|---|---|---|---|
| 2,708,175 | 5/1955 | Samfield et al. . | |
| 2,845,933 | 8/1958 | Samfield et al. . | |
| 3,353,541 | 11/1967 | Hind et al. . | |
| 3,385,303 | 5/1968 | Hind et al. . | |
| 3,386,449 | 6/1968 | Hind . | |
| 3,386,450 | 6/1968 | Seligman et al. . | |
| 3,398,754 | 9/1968 | Tughan . | |
| 3,409,026 | 11/1968 | Hind et al. . | |
| 3,411,514 | 11/1968 | Hind et al. . | |
| 3,411,515 | 11/1968 | Hind et al. . | |
| 3,420,241 | 1/1969 | Hind et al. . | |
| 3,428,053 | 2/1969 | Schoenbaum et al. . | |
| 3,435,829 | 4/1969 | Hind et al. . | |
| 3,464,422 | 9/1969 | Light . | |
| 3,480,018 | 11/1969 | Fairchild . | |
| 3,483,874 | 12/1969 | Hind . | |
| 3,499,454 | 3/1970 | Hind | 131/370 |
| 3,540,455 | 11/1970 | Fiore . | |
| 3,540,456 | 11/1970 | McGlumphy et al. . | |
| 3,616,801 | 11/1971 | Hind . | |
| 3,746,012 | 7/1973 | Deszyck | 131/370 |
| 3,760,815 | 9/1973 | Deszyck . | |
| 3,847,164 | 11/1974 | Mattina et al. . | |
| 4,182,349 | 1/1980 | Selke . | |
| 4,270,552 | 6/1981 | Jenkins et al. . | |
| 4,337,783 | 7/1992 | Hooper et al. . | |
| 4,341,228 | 7/1982 | Keritsis et al. . | |
| 4,421,126 | 12/1983 | Gellatly | 131/372 X |
| 4,611,608 | 9/1986 | Vos et al. . | |
| 4,674,519 | 6/1987 | Keritsis et al. . | |
| 4,706,692 | 11/1987 | Gellatly . | |
| 4,821,749 | 4/1989 | Toft et al. | 131/375 |
| 4,861,427 | 8/1989 | Johnson et al. . | |
| 4,874,000 | 10/1989 | Tamol et al. . | |
| 4,880,018 | 11/1989 | Graves, Jr. et al. . | |
| 4,962,774 | 10/1990 | Thomasson et al. . | |
| 4,972,854 | 11/1990 | Kiernan et al. . | |
| 4,987,906 | 1/1991 | Young et al. . | |
| 5,025,814 | 6/1991 | Raker . | |
| 5,099,864 | 3/1992 | Young et al. . | |
| 5,101,839 | 4/1992 | Jakob et al. . | |

FOREIGN PATENT DOCUMENTS

| | | | |
|---|---|---|---|
| 844348 | 6/1970 | Canada | 131/370 |

OTHER PUBLICATIONS

*Tobacco Encyclopedia,* Edited by Voges, pp. 389-390, TJI (1984).

Silberstein, *TJI,* vol. 1, pp. 26-29 (1985).

*Primary Examiner*—Jennifer Bahr

[57] ABSTRACT

The present invention relates to a method for providing a reconstituted tobacco material. The method includes contacting tobacco material dispersed in a liquid having an aqueous character with a humectant or binding agent or both under high shear mixing conditions at a temperature of at least about 35° C. to provide a mixture. The mixture is then contacted with a pectin release agent, preferably at a pH of about 5 to about 9, while maintaining the high shear mixing conditions to provide a tobacco material having released tobacco pectins. Preferably, the tobacco material having released tobacco pectins is then formed into a predetermined shape and subjected to conditions sufficient to cause the released tobacco pectins to undergo crosslinking.

33 Claims, 1 Drawing Sheet

METHOD FOR PROVIDING A RECONSTITUTED TOBACCO MATERIAL

CROSS-REFERENCE TO RELATED APPLICATIONS

This application is a continuation-in-part of copending application Ser. No. 07/800,679, filed Nov. 27, 1991, which is a continuation-in-part of copending application Ser. No. 07/567,519, filed Aug. 15, 1990, now U.S. Pat. No. 5,101,839 the disclosures of which are hereby incorporated herein by reference.

BACKGROUND OF THE INVENTION

The present invention relates to a method of preparing a substrate useful for smoking articles, and particularly to a reconstituted tobacco material for the same.

Cigarettes are popular smoking articles which have a substantially cylindrical rod shaped structure and include a charge of tobacco material surrounded by a wrapper, such as paper, thereby forming a so-called "tobacco rod." It has become desirable to manufacture a cigarette having a cylindrical filter aligned in an end-to-end relationship with the tobacco rod. Typically, a filter includes cellulose acetate circumscribed by plug wrap, and is attached to the tobacco rod using a circumscribing tipping material. See, Baker, Prog. Ener. Combust. Sci., Vol. 7, pp. 135–153 (1981).

Typical cigarettes include blends of various tobaccos, such as the flue-cured, Burley, Md. and Oriental tobaccos. Cigarette blends also can include certain amounts of processed and reconstituted tobacco materials. Reconstituted tobacco materials often are manufactured from tobacco stems, dust and scrap using papermaking processes. See, *Tobacco Encyclopedia*, edit. by Voges, pp. 389–390, TJI (1984). See, also, U.S. Pat. Nos. 3,385,303 to Hind, et al., U.S. Pat. No. 4,421,126 to Gellatly and U.S. Pat. No. 4,706,692 to Gellatly.

It would be desirable to provide a reconstituted tobacco material having mechanical and physical properties comparable to natural tobacco materials and reconstituted tobacco material manufactured using papermaking processes.

SUMMARY OF THE INVENTION

The present invention relates to a method for providing a reconstituted tobacco material. The process includes contacting tobacco material dispersed in a liquid having an aqueous character with a humectant or binding agent or both under high shear mixing conditions at a temperature of at least about 35° C. to provide a mixture (i.e., a slurry). The mixture is then contacted with a pectin release agent, preferably at a pH of about 5 to about 9, while maintaining the high shear mixing conditions to provide a tobacco material having released tobacco pectins. Preferably, the tobacco material having released tobacco pectins is then formed into a predetermined shape and subjected to conditions sufficient to cause the released tobacco pectins to undergo crosslinking. Exemplary conditions include reducing the moisture content of the slurry so as to allow crosslinking agents naturally present in the slurry to crosslink the released tobacco pectins. If desired, the formed tobacco material can be contacted with a crosslinking agent capable of causing any remaining released pectins to undergo crosslinking. Such a crosslinking agent is a source of alkaline earth metal ions (e.g., calcium ions).

The resulting reconstituted tobacco material can be employed using techniques known in the art. For example, the reconstituted tobacco material can be provided in a sheet-like form having a thickness approximating that of tobacco leaf laminae; and the material can be used as is or can be blended with other tobacco materials, cut to the desired size, and employed as smokable cut filler. The reconstituted tobacco material can be rolled onto a bobbin and later formed into smokable rods using known techniques. For example, the reconstituted tobacco material can be slit, gathered and cut into strands such as described in U.S. Pat. No. 5,025,814 to Raker, the disclosure of which is incorporated herein by reference. The reconstituted tobacco material can be used as a substrate in a smoking article such as described in copending parent application, U.S. Ser. No. 07/800,679 filed Nov. 27, 1991, the disclosure of which is incorporated herein by reference.

Reconstituted tobacco materials which are manufactured according to the method of the present invention have excellent smoking properties and improved flavor attributes relative to reconstituted tobacco materials made using conventional processes and have mechanical and physical properties comparable thereto.

DETAILED DESCRIPTION OF THE PREFERRED EMBODIMENTS

Figure 1:
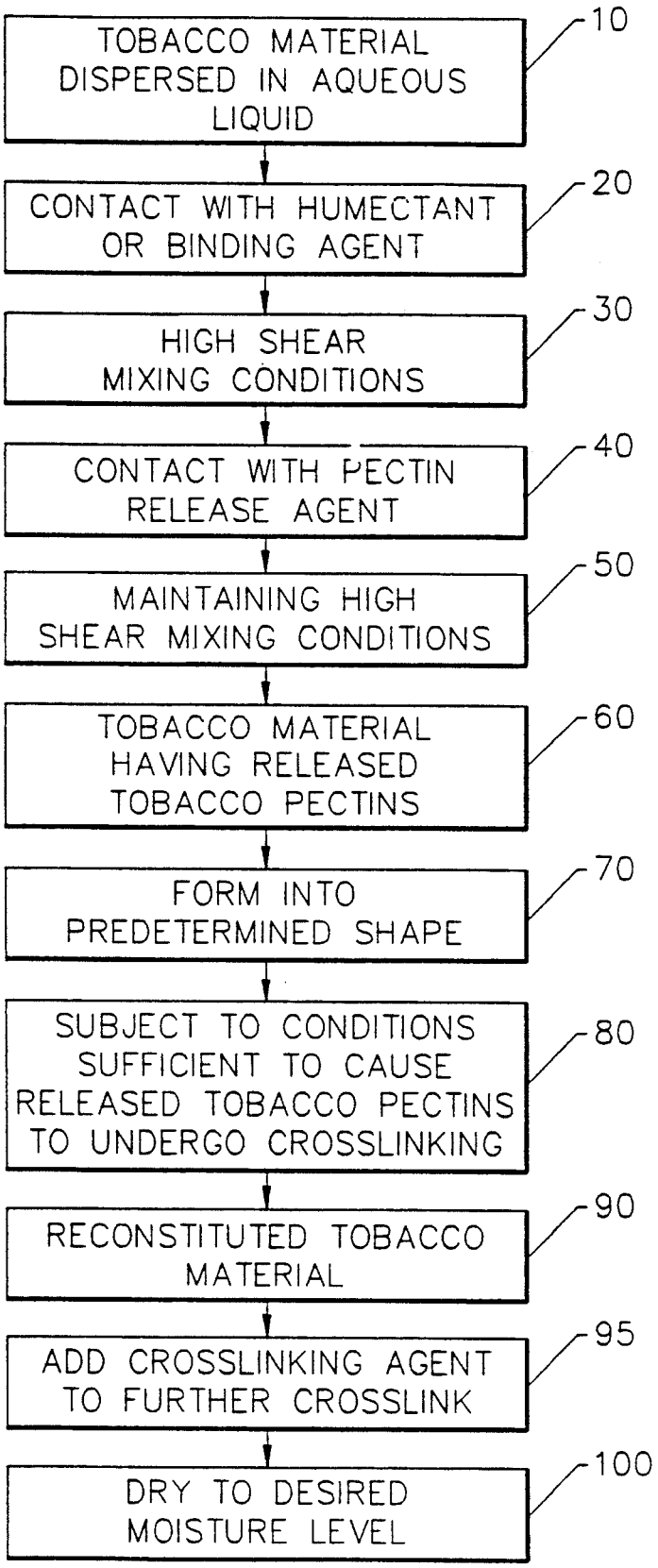
FIG. 1 is a schematic diagram of steps representative of an embodiment of the invention.

Referring to FIG. 1, tobacco material 10 is dispersed in a liquid having an aqueous character. The tobacco material 10 is contacted 20 with a humectant or binding agent or both under high shear mixing conditions 30 to provide a mixture. The mixture is contacted 40 with a pectin release agent while maintaining 50 the high shear mixing conditions to provide a tobacco material having released tobacco pectins 60. Preferably, the tobacco material having released tobacco pectins 60 is formed 70 into a predetermined shape and subjected 80 to conditions sufficient to cause the released tobacco pectins to undergo crosslinking to provide a reconstituted tobacco material 90. The reconstituted tobacco material can be used as is, or an agent for further crosslinking the reconstituted tobacco material can be added 95 and the further crosslinked reconstituted tobacco material dried 100 to the desired moisture level.

Tobacco materials used in the process of the present invention can vary. Examples of suitable types of tobaccos include flue-cured, Burley and Maryland tobaccos, although other types of tobacco can be employed. The tobacco material generally has been aged, and can be in the form of laminae and/or stem, or can be in a processed form. Typically, the tobacco material employed is a waste material and/or processing by-product such as fines, dust, scrap or stem. All or part of the tobacco material can be previously cased and/or top dressed. The tobacco material can be screened or otherwise processed to remove impurities (e.g., sand) therefrom. Techniques for removing particular impurities from particular tobacco materials can vary, depending upon factors such as the form of the tobacco material being processed; and such techniques will be apparent to the skilled artisan. Impurity removal, however, is not critical, and tobacco material having impurity levels of greater than 50 percent can be used. The aforementioned materials can be processed separately, or as blends thereof.

The tobacco material is dispersed in a liquid having an aqueous character at a temperature of greater than ambient temperature (e.g., 25° C.), preferably greater than about 35° C., and often greater than about 55° C.. Such a liquid consists primarily of water, normally greater than 90 weight percent water, and can be essentially pure water in certain circumstances. Essentially pure water includes deionized water, distilled water and tap water. However, the liquid can include substances such as pH buffers or the like dissolved therein. The liquid also can be a co-liquid mixture of water and minor amounts of one or more solvents which are miscible therewith. An example of such a co-liquid mixture is a liquid consisting of 95 parts water and 5 parts ethanol.

The amount of tobacco material which is dispersed in the liquid can vary. Typically, the weight of liquid relative to the tobacco material is greater than about 4:1, and often times greater than about 5:1. The amount of liquid relative to tobacco material depends upon factors such as the type of liquid, the temperature at which the high shear mixing is performed, the type or form of tobacco which is used, and other such factors.

Humectants used in the method of the present invention can vary. Examples of suitable humectants include the polyhydric alcohols (e.g., glycerin, propylene glycol, triethylene glycol and tetraethylene glycol), the aliphatic esters of mono-, di-, or polycarboxylic acids (e.g., methyl stearate, dimethyl dodecandioate and dimethyl tetradecanedioate), Hystar TPF available from Lonza, Inc., and the like, as well as mixtures thereof. Combinations of humectants can be employed. For example, glycerin, triethylene glycol and Hystar TPF can be mixed together to form a humectant. Preferably, the amount of humectant ranges from about 0.5 to 3 percent, and preferably from about 1 to about 2 percent based on the dry weight of the tobacco material used. Additional amounts of humectants can be utilized if aerosol forming characteristics are desired such as described in the parent application U.S. Ser. No. 07/800,679 filed Nov. 27, 1991.

Binding agents used in the method of the present invention can vary. Examples of suitable binding agents include reticulated bacterial cellulose (e.g., Cellulon TM available from Weyerhaeuser Company, Tacoma, Washington and discussed in U.S. Pat. No. 4,861,427 to Johnson et al., the disclosure of which is incorporated herein by reference); natural cellulosic materials having a high cellulose content (i.e., an alpha-cellulose content above about 80 weight percent) such as wood pulp; high solid sugars (e.g., high fructose corn syrup and solid fructose); and, alginates (e.g., ammonium alginate, propylene glycol alginate, potassium alginate and sodium alginate). Other useful binding agents include hydroxypropylcellulose such as Klucel H from Aqualon Co.; hydroxypropylmethylcellulose such as Methocel K4MS from The Dow Chemical Co.; hydroxyethylcellulose such as Natrosol 250 MRCS from Aqualon Co.; methylcellulose such as Methocel A4M from The Dow Chemical Co.; and sodium carboxymethylcellulose such as CMC 7HF and CMC 7H4F from Hercules Inc. Another useful binding agent is RBX binder available from Nuway-Microflake Inc., South Windsor, Connecticut and Solka-Floc available from Protein Technology International, Urbana, Ohio. The binding agent can also be a combination of at least two binders, and can be capable of being activated under the conditions of temperature, pressure and moisture which are experienced by the binding agent during casting conditions. The binding agent can include a galactomannan and at least one other binder. Examples of preferred galactomannans are locust bean gum and tara gum, of which locust bean gum is especially preferred. Examples of the other binders are those which undergo a heat initiated interaction with the galactomannan. Examples of especially preferred other binders are the carrageenans such as kappa-carrageenan, and the xanthomonas hydrophilic colloid (also commonly known as xanthan gum); of which xanthan gum is most preferred. For example, a synergistic mixture of solubilized locust bean gum and xanthan gum can reversibly form a gel after cooling a heated aqueous mixture thereof to below the gel point of the binding agent (i.e., to below a temperature of about 55° C.). Additionally, if a binding agent is used, the use of a pectin release agent is optional. Preferably, the amount of binding agent ranges from about 0.0 to about 10 percent, and preferably from about 2 to 6 percent based on the dry weight of tobacco material used.

The tobacco material dispersed in the liquid having an aqueous character is contacted with the humectant and/or binding agent under high shear mixing conditions to provide a mixture (i.e., a slurry). The high shear mixing conditions include mixing the mixture so that the Brookfield viscosity is greater than about 10,000 cps while maintaining the temperature of at least 35° C. and while avoiding temperatures greater than the boiling point of the mixture. Mixing is continued at a sufficiently high shear, preferably for about 15 minutes to about 1.5 hours, and more preferably for about 20 minutes to about 35 minutes to release tobacco pectins via depolymerization and de-esterification. Exemplary high shear mechanical-type mixers are preferred and include a Cowles mixer available from C. Cowles and Company, New Haven, Connecticut and a Myers mixer available from C. K. "Bud" Myers Engineering, Inc., Bell, Calif. Ultrasonic mixers such as described in U.S. Pat. No. 4,972,854 to Kiernan et al. can also be used. Preferably the mixer is jacketed and is heated by hot water or steam to maintain the temperature of the mixture of at least 35° C.

The mixture (slurry) can be contacted with ammonia, or any other suitable reagent (e.g., potassium hydroxide, sodium hydroxide, etc.) capable of providing the mixture in the desired Ph range of about 5 to about 9, and preferably about 6 to about 8. Preferably, the ammonia is essentially aqueous ammonium hydroxide. Although the manner of contact can vary, it generally is convenient to inject gaseous ammonia into the mixture. For example, gaseous anhydrous ammonia can be bubbled through the mixture. Alternatively, a concentrated ammonium hydroxide solution can be pumped into contact with the mixture. The amount of ammonia required to provide the mixture at the desired Ph will be apparent to the skilled artisan. Normally, contact of the ammonia and mixture occurs at a temperature of about 35° C. to about 90° C., preferably about 40° C. to about 70° C., most preferably about 50° C. to about 60° C.

If desired, certain flavorful agents and tobacco flavor modifications can also be incorporated into the mixture (slurry). For example, menthol, vanillin, glycerine, potassium sorbate, licorice, cocoa, organic acids and the like, can be incorporated into the mixture. Tobacco flavor modifiers such as levulinic acid, metal salts (e.g., sodium, potassium, calcium and magnesium) of levulinic acid, tobacco-based flavors such as tobacco extracts (e.g., Oleoresin oriental tobacco extract available from Givaudan Corporation of East Hanover, N.J.) and the like, may also be used. Other useful flavoring agents are set forth in Leffingwell et al., *Tobacco Flavoring For Smoking Products* (1972) and in European Patent Publication No. 407,792. Other additives such as urea, potassium sorbate, amino acids and organic acids (e.g., citric acid, malic acid and fumaric acid) can be incorporated in the tobacco material.

If desired, organic and inorganic materials can be incorporated as fillers in the tobacco material of the present invention. Such materials often have a fibrous, flake, crystalline, amorphous, hollow or particulate form. Examples of useful organic materials include wood pulp fibers, flax fibers and other cellulosic materials. Examples of useful inorganic materials include calcium carbonate, calcium sulfate particles, magnesium oxide, magnesium hydroxide, perlite, synthetic mica, vermiculite, clays, carbon such as in the form of thermally stable carbon fibers, zinc oxide, dowsonite, low density hollow spheres of calcium carbonate, glass spheres, glass bubbles, thermally stable carbon microspheres, alumina, calcium carbonate agglomerated using a carbonaceous component, calcium carbonate agglomerated using an organic material, low density processed calcium carbonate and the like.

The mixture is contacted with an agent capable of destroying the alkaline earth metal crosslinks of pectins present within the tobacco material such as described in commonly assigned U.S. Ser. No. 07/769,914 filed Sep. 30, 1991, the disclosure of which is incorporated herein by reference. Such an agent commonly is referred to as a "crosslink destruction agent" or a "pectin release agent." One preferred pectin release agent is a water soluble phosphate salt. Examples of such salts include diammonium hydrogen orthophosphate, ammonium dihydrogen orthophosphate, and potassium dihydrogen phosphate. Glyoxal and triethylene glycol can also be used as pectin release agents. See, also, those pectin release agents proposed in U.S. Pat. No. 3,435,829 to Hind, et al., and other methods of releasing pectins proposed in U.S. Pat. No. 4,674,519 to Keritsis et al. U.S. Pat. No. 4,972,854 to Kiernan et al. and U.S. Pat. No. 5,099,864 to Young et al., the disclosures of which are incorporated herein by reference. Normally, the pectin release agent is provided in solution form and then contacted with the tobacco material of the slurry to ensure destruction of the alkaline earth metal ion crosslinks of the tobacco pectins within such tobacco material. Typically this is done by mixing the pectin release agent with the tobacco material, humectant and/or binding agent. The temperature of the mixture and pectin release agent during contact can vary, but usually ranges from about 20° C. to about 80° C., and is preferably about 25° C. to about 45° C.. If desired, the pectin release agent can be formed in situ by contacting the tobacco material with separate components (e.g., an aqueous solution of ammonium hydroxide and an aqueous solution of phosphoric acid can be separately applied to the tobacco material).

The amount of pectin release agent which is contacted with the tobacco material of the slurry can vary, and can depend upon the particular pectin release agent. Typically, the amount of pectin release agent is sufficient to form precipitates with the alkaline earth metal ions which crosslink the tobacco pectins. However, the amount of pectin release agent should not be so high as to require the application of exceedingly high levels of alkaline earth metal ions (e.g., as tobacco extract and/or as water soluble alkaline earth salts) to the tobacco material in order to cause the re-crosslinking of the released tobacco pectins. That is, it is desirable to apply sufficient pectin release agent to the tobacco material of the slurry to release the pectins therewithin; while it is desirable to avoid the application of a great excess of pectin release agent so that the source of alkaline earth metal ions which is applied later in the process steps is employed to re-crosslink the released tobacco pectins rather than interact with pectin release agent. Typically, the amount of pectin release agent ranges from about 0 percent to about 10 percent, preferably about 2 percent to about 6 percent, based on dry weight of the tobacco material to which that agent is applied.

The slurry of tobacco material having released tobacco pectins is then formed into a sheet-like shape using a conventional forming machine or other means for forming known to those skilled in the art. For example, a forming machine comprising a headbox, a continuous belt preferably formed of a non-porous material such as stainless steel, and a series of dryers can be utilized. The slurry of tobacco material having released tobacco pectins is transferred to the headbox and is laid onto the belt as a sheet-like shape at a temperature of about 40° C. to a thickness of about 0.015 to about 0.030 inches, and preferably from about 0.020 inches to about 0.025 inches. The formed tobacco material (cast slurry) having released tobacco pectins is heated and dried through the series of dryers to a moisture content of about 10 to about 20 weight percent, preferably to a moisture content of about 12 to about 14 weight percent. Drying of the cast slurry can be provided using a variety of techniques. For example, the cast slurry can be (i) air dried under ambient conditions, (ii) heated on a heated metal surface, (iii) subjected to contact with heated air, or (iv) heated on a heated metal surface and subjected to contact with heated air. If desired, prior to entering the headbox, the tobacco material having released tobacco pectins can be refined into particles having a uniform particle size such as utilizing a Fitz Mill Comminutor available from the Fitzpatrick Co., Elmhurst, Illinois.

The formed tobacco material (cast slurry) can be subjected to conditions sufficient to cause the released tobacco pectins to undergo crosslinking. It is desirable to have sufficient alkaline earth metal ions (e.g., calcium ions) in the cast slurry to provide for crosslinking of the released tobacco pectins. The alkaline earth metal ions can be naturally occurring in the cast slurry. Drying the cast slurry causes the released tobacco pectins to have a propensity to crosslink due to a relative increase in concentration of the alkaline earth metal ions as the moisture content of the cast slurry decreases. Alternatively, the cast slurry can be further crosslinked by contacting with an amount of a crosslinking agent capable of providing additional alkaline earth metal ions. The alkaline earth metal ions are typically in a water soluble form. For example, the alkaline earth metal ions can be applied as a spray dried tobacco extract dissolved in water, such as described in commonly assigned, copending U.S. Ser. No. 931,248, filed Aug. 17, 1992, the disclosure of which is incorporated herein by reference. The source of alkaline earth metal ions can alternatively be a water soluble alkaline earth metal salt (e.g., an aqueous solution of calcium chloride).

Preferably, the crosslinking of the released tobacco pectins is controlled to either cause the released tobacco pectins to have the propensity to crosslink (i.e., the amount or rate of crosslinking is enhanced) or to not have the propensity to crosslink (i.e., the amount or rate of crosslinking is reduced or retarded). For example, different pH and temperature levels can be utilized to control the crossing. Alternatively, the crosslinking agent can include a crosslinking control agent which controls the amount or rate of crosslinking, and can be applied to the cast slurry in combination with the alkaline earth metal ions. Exemplary crosslink control agents include various organic acid flavor modifiers such as citric acid, malic acid, maleic acid, fumaric acid and levulinic acid; hydrogen chloride; ammonium chloride; and phosphate buffers. The use of different combinations and amounts of the various crosslinking control agents and crosslinking agents can be determined by routine experimentation depending on such factors as the composition of the tobacco material, treatment conditions of the cast slurry, treatment conditions of the tobacco material, amount of pectin release agent and the like, and the determination thereof will be within the skill of one in the art.

The amount of water soluble alkaline earth metal ions contacted with the formed tobacco material (cast slurry) is at least sufficient to cause any remaining released pectins to undergo alkaline earth metal crosslinking. For example, the crosslinking agent can be uniformly applied to the formed (cast) tobacco material using a series of spray nozzles, roll coating, or other such means. However, the manner and number of times of applying the further amount crosslinking agent to the tobacco material is not particularly critical.

The amount of crosslinking agent applied to the formed tobacco material (cast slurry) can vary. The amount is typically greater than about 0.1 percent, often is from about 0.1 to about 0.5 percent, and preferably is about 0.2 to about 0.4 percent based on the dry weight of the cast slurry prior to application of the crosslinking agent. Normally, the moisture content of the tobacco material just prior to the time that when further amount of crosslinking agent is applied thereto ranges from about 60 to 85 percent, based on the weight of the cast material and moisture. The resulting formed tobacco material is such that the weight thereof is greater than about 20 $g/m^2$, preferably about 25 $g/m^2$ to about 140 $g/m^2$, and more preferably about 80 $g/m^2$ to about 100 $g/m^2$, on a dry weight basis. The formed tobacco material (cast slurry) having the further amount of crosslinking agent applied thereto is dried, preferably at a gradual temperature gradient, to remove moisture therefrom using one or more dryers, or the like. The resulting reconstituted tobacco material is dried to a moisture content of about 10 to 20 weight percent, and preferably to a moisture content of about 12 to 14 percent. Typically the dryer is set such that the product dries at 100° C. or less for 1 to 4 minutes. The dryer temperature and the adjustment thereof is within one skilled in the art.

If desired, additional flavorful agents and tobacco flavor modifers and additives can be incorporated into the formed tobacco material before or after drying and/or subjecting to crosslinking conditions.

The reconstituted tobacco material can be wound onto a bobbin and formed into smokable rods using techniques described in U.S. Pat. Nos. 4,807,809 to Pryor et al. and U.S. Pat. No. 5,074,320 to Jones, Jr. et al. and in U.S. Patent application Ser. No. 585,444 filed Sep. 20, 1990. Reconstituted tobacco materials also can be formed into rods using a rod making unit available as CU-10 or CU-10S from Decoufle s.a.r.b., together with a KDF-2 rod making apparatus from Hauni-Werke Korber & Co., K. G.; or as set forth in U.S. Pat. No. 4,283,186 at col. 4, line 50 through col. 5, line 6. The reconstituted tobacco material can be slit, gathered and cut into strands, and formed into smokable rods such as described in U.S. Pat. No. 5,025,814 to Raker, the disclosure of which is incorporated herein by reference.

The following examples are provided in order to further illustrate various embodiments of the invention but should not be construed as limiting the scope thereof. Unless otherwise noted, all parts and percentages are by weight.

EXAMPLE 1

144 lbs of tobacco material in the form of stemmery dust is dispersed in 1000 lbs of tap water heated to 88° C. 10 lbs of high fructose corn syrup (45% water) binding agent is added to the stemmery dust and mixed in a high shear Cowles mixer at 1160 rpm to provide a mixture (slurry) while maintaining the 88° C. temperature. 8 lbs of diammonium hydrogen orthophosphate is added to the mixture and mixing is continued for 30 minutes. The pH is adjusted to 7.3 using 4.8 1 of ammonium hydroxide. The high shear mixing is continued for about 30 minutes to provide a tobacco material having released tobacco pectins.

The tobacco material having released tobacco pectins is sheared by passing through a Fitz Mill Comminutor having a 0.030 inch mesh screen and forming into a mass. The mass is cast at wet mass thickness of about 0.025 inches at a rate of about 2 gallons/min by extruding through the nip of a cast-sheet line head box. The cast mass is gradually dried at a temperature of about 100° C. to a moisture content of about 14 percent. The mechanical properties of the cast sheet are listed in Table 1.

EXAMPLE 2

144 lbs of tobacco material in the form of stemmery dust is dispersed in 750 lbs of tap water heated to 88° C. 7.2 lbs of high fructose syrup (45% water) binding agent is added to the stemmery dust and mixed in a high shear Cowles mixer at 1160 rpm to provide a mixture while maintaining the 88° C. temperature. 8 lbs of diammonium hydrogen orthophosphate is added to the mixture and mixing is continued for 30 minutes. The pH is adjusted to 7.9 using 4.8 1 of ammonium hydroxide. The high shear mixing is continued for about 30 minutes to provide a tobacco material having released tobacco pectins.

The tobacco material having released tobacco pectins is sheared by passing through a Fitz Mill Comminutor having a 0.030 inch mess screen and forming into a mass. The mass is cast at wet mass thickness of about 0.025 inches at a rate of about 2 gallons/min by extruding through the nip of a cast sheet line head box. The cast mass is gradually dried at a temperature of about 100° C. to a moisture content of about 14 percent. The mechanical properties of the cast sheet are listed in Table 1.

EXAMPLE 3

13 lbs of tobacco material in the form of 7.15 lbs of stemmery dust and 5.85 lbs of stems is dispersed in 8 gal of tap water heated to 88° C. 0.13 lbs of 1:1 exanthem gum and locust bean binding agent is added to the stemmery dust and mixed in a high shear Myers mixer at 2200 to 4350 rpm to provide a mixture while maintaining the 88° C. temperature. 332.9 g of diammonium hydrogen orthophosphate in 2400 ml of water is added to the mixture and mixing is continued for 30 minutes. The pH is adjusted to 7.3 using 442.5 ml of ammonium hydroxide. The high shear mixing is continued for about 30 minutes to provide a tobacco material having released tobacco pectins.

The tobacco material having released tobacco pectins is sheared by passing through a Fitz Mill Comminutor having a 0.030 inch mesh screen and forming into a mass. The mass is cast at wet mass thickness of about 0.025 inches at a rate of about 2 gallons/min by extruding through the nip of a cast-sheet line head box. The cast mass is gradually dried at a temperature of about 25° C. to about 30° C. to a moisture content of about 14 percent. The mechanical properties of the cast sheet are listed in Table 1.

EXAMPLE 4

13 lbs of tobacco material in the form of 7.15 lbs stemmery dust and 5.85 lbs of stems is dispersed in 8 gal of tap water heated to 88° C. 0.39 lbs of high fructose corn syrup (45% water) binding agent is added to the tobacco material and mixed in a high shear Cowles mixer at 1160 rpm to provide a mixture while maintaining the 88° C. temperature. 332.9 g of diammonium hydrogen orthophosphate in 2400 ml of water is added to the mixture and mixing is continued for 30 minutes. The pH is adjusted to 7.3 using 442.5 ml of ammonium hydroxide. The high shear mixing is continued for about 30 minutes to provide a tobacco material having released tobacco pectins.

The tobacco material having released tobacco pectins is sheared by passing through a Fitz Mill Comminutor having a 0.030 inch mesh screen and forming into a mass. The mass is cast at wet mass thickness of about 0.025 inches at a rate of about 2 gallons/min by extruding through the nip of a cast-sheet line head box. The cast mass is gradually dried at a temperature about 100° C. to a moisture content of about 14 percent. The mechanical properties of the cast sheet are listed in Table 1.

EXAMPLE 5

13 lbs of tobacco material in the form of 7.15 lbs of stemmery dust and 5.85 lbs of stems is dispersed in 8 gal of tap water heated to 88° C. 0.39 lbs of high fructose corn syrup (45% water) and 0.13 lbs of 1:1 xanthan and locust bean binding agent is added to the tobacco material in a high shear Myers mixer at 2200 rpm to provide a mixture while maintaining the 88° C. temperature. 332.9 g of diammonium hydrogen orthophosphate in 2400 ml of water is added to the mixture and mixing is continued for 30 minutes. The Ph is adjusted to 7.3 using 442.5 ml of ammonium hydroxide. The high shear mixing is continued for about 30 minutes to provide a tobacco material having released tobacco pectins.

The tobacco material having released tobacco pectins is sheared by passing through a Fitz Mill Comminutor having a 0.030 inch mesh screen and forming into a mass. The mass is cast at wet mass thickness of about 0.025 inches at a rate of about 2 gallons/min by extruding through the nip of a cast-sheet line head box. The cast mass is gradually dried at a temperature of about 100° C. to a moisture content of about 14 percent. The mechanical properties of the cast sheet are listed in Table 1.

EXAMPLE 6

13 lbs of tobacco material in the form of 7.15 lbs of stemmery dust and 5.85 lbs of stems is dispersed in 8 gal of tad water heated to 88° C. 0.195 lbs of glycerin (humectant) is added to the tobacco material and mixed in a high shear Myers mixer at 2200 rpm to 4350 rpm to provide a mixture while maintaining the 88° C. temperature. 332.9 g of diammonium hydrogen orthophosphate in 2400 ml of water is added to the mixture and mixing is continued for 30 minutes. The pH is adjusted to 7.3 using 442.5 ml of ammonium hydroxide. The high shear mixing is continued for about 30 minutes to provide a tobacco material having released tobacco pectins.

The tobacco material having released tobacco pectins is sheared by passing through a Fitz Mill Comminutor having a 0,030 inch mesh screen and forming into a mass. The mass is cast at wet mass thickness of about 0.025 inches at a rate of about 2 gallons/min by extruding through the nip of a cast-sheet line head box. The cast mass is gradually dried at a temperature of about 100° C. to a moisture content of about 14 percent. The mechanical properties of the cast sheet are listed in Table 1.

EXAMPLE 7

13 lbs of tobacco material in the form of 7.15 lbs stemmery dust and 5.85 lbs of stems is dispersed in 8 gal of tap water heated to 88° C. 0.39 lbs of high fructose corn syrup (45% water), 0.13 lbs of 1:1 xanthan and locust bean binding agent and 0.39 lbs of glycerin (humectant) is added to the tobacco material and mixed in a high shear Myers mixer at 2200 rpm to 4350 rpm to provide a mixture while maintaining the 88° C. temperature. 332.9 g of diammonium hydrogen orthophosphate in 2400 ml of water is added to the mixture and mixing is continued for 30 minutes. The pH is adjusted to 7.3 using 442.5 ml of ammonium hydroxide. The high shear mixing is continued for about 30 minutes to provide a tobacco material having released tobacco pectins.

The tobacco material having released tobacco pectins is sheared by passing through a Fitz Mill Comminutor having a 0.030 inch mesh screen and forming into a mass. The mass is cast at wet mass thickness of about 0.025 inches at a rate of about 2 gallons/min by extruding through the nip of a cast-sheet line head box. The cast mass is gradually dried at a temperature of about 100° C. to a moisture content of about 14 percent. The mechanical properties of the cast sheet are listed in Table 1.

EXAMPLE 8

11.7 lbs of tobacco material in the form of stemmery dust is dispersed in 8 gal of tap water heated to 88° C. 1.3 lbs of Cellulon® reticulated bacterial cellulose binding agent is added to the stemmery dust and mixed in a high shear Myers mixer at 2200 rpm to 4350 rpm to provide a mixture while maintaining the 88° C. temperature. 332.9 g of diammonium hydrogen orthophosphate in 2400 ml of water is added to the mixture and mixing is continued for 30 minutes. The pH is adjusted to 7.3 using 442.5 ml of ammonium hydroxide. The high shear mixing is continued for about 30 minutes to provide a tobacco material having released tobacco pectins.

The tobacco material having released tobacco pectins is sheared by passing through a Fitz Mill Comminutor having a 0.030 inch mesh screen and forming into a mass. The mass is cast at wet mass thickness of about 0.025 inches at a rate of about 2 gallons/min by extruding through the nip of a cast-sheet line head box. The cast mass is gradually dried at a temperature of about 100° C. to a moisture content of about 14 percent. The mechanical properties of the cast sheet are listed in Table 1.

EXAMPLE 9

11.7 lbs of tobacco material in the form of stemmery dust is dispersed in 8 gal of tap water heated to 88° C. 1.3 lbs of carboxymethylcellulose binding agent is added to the stemmery dust and mixed in a high shear Myers mixer at 2200 rpm to 4350 rpm to provide a mixture while maintaining the 88° C. temperature. 332.9 g of diammonium hydrogen orthophosphate in 2400 ml of water is added to the mixture and mixing is continued for 30 minutes. The pH is adjusted to 7.3 using 442.5 ml of ammonium hydroxide. The high shear mixing is continued for about 30 minutes to provide a tobacco material having released tobacco pectins.

The tobacco material having released tobacco pectins is sheared by passing through a Fitz Mill Comminutor having 0.030 inch mesh screen and formed into mass. The mass is cast at wet mass thickness of about 0.025 inches at a rate of about 2 gallons/min by extruding through the nip of a cast-sheet line head box. The cast mass is gradually dried at a temperature of about 100° C. to a moisture content of about 14 percent. The mechanical properties of the cast sheet are listed in Table 1.

EXAMPLE 10

66.8 lbs of tobacco material in the form of stemmery dust is dispersed in 1000 lbs of tap water heated to 88° C. 22.3 lbs of high fructose corn syrup (45% water) binding agent and 22.3 lbs of ammonium alginate binding agent, and 134.0 lbs of calcium carbonate filler, is added to the stemmery dust and mixed in a high shear Cowles mixer at 1160 rpm to provide a mixture while maintaining the 88° C. temperature. 4.4 lbs of diammonium hydrogen orthophosphate is added to the mixture and mixing is continued for 30 minutes. The pH is adjusted to 8.8 using 4.4 1 of ammonium hydroxide. The high shear mixing is continued for about 30 minutes to provide a tobacco material having released tobacco pectins.

The tobacco material having released tobacco pectins is sheared by passing through a Fitz Mill Comminutor having a 0.030 inch mesh screen and forming into a mass. The mass is cast at wet mass thickness of about 0.025 inches at a rate of about 2 gallons/min by extruding through the nip of a cast-sheet line head box. The cast mass is gradually dried at a temperature of about 100° C. to a moisture content of about 14 percent. The mechanical properties of the cast sheet are listed in Table 1.

EXAMPLE 11

71.7 lbs of tobacco material in the form of stemmery dust is dispersed in 1000 lbs of tap water heated to 88° C. 23.9 lbs of high fructose syrup (45% water) binding agent, 19.2 lbs ammonium alginate binding agent 143.2 lbs calcium carbonate filler is added to the stemmery dust and mixed in a high shear Cowles mixer at 1160 rpm to provide a mixture while maintaining the 88° C. temperature. 4.7 lbs of diammonium hydrogen orthophosphate is added to the mixture and mixing is continued for 30 minutes. The pH is adjusted to 8.6 using 17.9 1 of ammonium hydroxide. The high shear mixing is continued for about 30 minutes to provide a tobacco material having released tobacco pectins. 13.1 lbs of tobacco based flavor extract is added to further cross-link the mixture.

The tobacco material having released tobacco pectins is sheared by passing through a Fitz Mill Comminutor having a 0,030 inch mess screen and forming into a mass, The mass is cast at wet mass thickness of about 0,025 inches at a rate of about 2 gallons/min by extruding through the nip of a cast-sheet line head box. The cast mass is gradually dried at a temperature of about 100° C. to a moisture content of about 14 percent. The mechanical properties of the cast sheet are listed in Table 1.

EXAMPLE 12

11.4 lbs of tobacco material in the form of stemmery dust is dispersed in 10 gal of tap water heated to 88° C. 0.39 lbs of cellulose pulp filler and 0.12 lbs of 1:1 exanthem gum and locust bean binding agent is added to the stemmery dust and mixed in a high shear Cowles mixer at 1160 rpm to provide a mixture while maintaining the 88° C. temperature, 0.73 lbs of diammonium hydrogen orthophosphate is added to the mixture and mixing is continued for 30 minutes, The pH is adjusted to 7.25 using 442.5 ml of ammonium hydroxide. The high shear mixing is continued for about 30 minutes to provide a tobacco material having released tobacco pectins.

The tobacco material having released tobacco pectins is sheared by passing through a Fitz Mill Comminutor having a 0.030 inch mesh screen and forming into a mass. The mass is cast at wet mass thickness of about 0.025 inches at a rate of about 2 gallons/min by extruding through the nip of a cast-sheet line head box. The cast mass is gradually dried at a temperature of about 100° C. to a moisture content of about 14 percent. The mechanical properties of the cast sheet are listed in Table 1.

EXAMPLE 13

9.10 lbs of tobacco material in the form of stemmery dust is dispersed in 10 gal of tap water heated to 88° C. 0.78 lbs of cellulose pulp filler, 1.56 lbs of high fructose syrup (45% water) binding agent 1.56 lbs of calcium sulfate filler and 0.12 lbs of 1:1 exanthem gum and locust bean binding agent are added to the stemmery dust and mixed in a high shear Cowles mixer at 1160 rpm to provide a mixture while maintaining the 88° C. temperature. 0.73 lbs of diammonium hydrogen orthophosphate is added to the mixture and mixing is continued for 30 minutes. The pH is adjusted to 7.25 using 442.5 ml of ammonium hydroxide. The high shear mixing is continued for about 30 minutes to provide a tobacco material having released tobacco pectins.

The tobacco material having released tobacco pectins is sheared by passing through a Fitz Mill Comminutor having a 0.030 inch mess screen and forming into a mass. The mass is cast at wet mass thickness of about 0.025 inches at a rate of about 2 gallons/min by extruding through the nip of a cast sheet line head box. The cast mass is gradually dried at a temperature of about 100° C. to a moisture content of about 14 percent. The mechanical properties of the cast sheet are listed in Table 1.

EXAMPLE 14

9.10 lbs of tobacco material in the form of stemmery dust is dispersed in 10 gal of tap water heated to 88° C. 0.78 lbs of cellulose pulp filler, 1.56 lbs of high fructose syrup (45% water) binding agent 1.56 lbs of calcium sulfate filler and 0.12 lbs of 1:1 exanthem gum and locust bean binding agent are added to the stemmery dust and mixed in a high shear Cowles mixer at 1160 rpm to provide a mixture while maintaining the 88° C. temperature. 0.73 lbs of diammonium hydrogen orthophosphate is added to the mixture and mixing is continued for 30 minutes. The pH is adjusted to 7.25 using 442.5 ml of ammonium hydroxide. The high shear mixing is continued for about 30 minutes to provide a tobacco material having released tobacco pectins.

The tobacco material having released tobacco pectins is sheared by passing through a Fitz Mill Comminutor having a 0.030 inch mess screen and forming into a mass. The mass is cast at wet mass thickness of about 0.025 inches at a rate of about 2 gallons/min by extruding through the nip of a cast sheet line head box. The cast mass is saturated until visually moist with Oleoresin oriental tobacco extract available from Givaudan Corporation, East Hanover, N.J.and is gradually dried at a temperature of about 100° C. to a moisture content of about 14 percent. The mechanical 20 properties of the cast sheet are listed in Table 1.

EXAMPLE 15

11.4 lbs of tobacco material in the form of stemmery dust is dispersed in 9 gal of tap water heated to 88° C. 1.56 lbs of cellulose pulp filler and 0.12 lbs of 1:1 exanthem gum and locust bean binding agent is added to the stemmery dust and mixed in a high shear Cowles mixer at 1160 rpm to provide a mixture while maintaining the 88° C. temperature. 0.73 lbs of diammonium hydrogen orthophosphate is added to the mixture and mixing is continued for 30 minutes. The pH is adjusted to 7.40 using 442.5 ml of ammonium hydroxide. The high shear mixing is continued for about 30 minutes to provide a tobacco material having released tobacco pectins.

The tobacco material having released tobacco pectins is sheared by passing through a Fitz Mill Comminutor having a 0.030 inch mesh screen and forming into a mass. The mass is cast at wet mass thickness of about 0.025 inches at a rate of about 2 gallons/min by extruding through the nip of a cast-sheet line head box. The cast mass is saturated until visually moist with Oleoresin oriental tobacco extract and is gradually dried at a temperature of about 100° C. to a moisture content of about 14 percent.

EXAMPLE 16

11.4 lbs of tobacco material in the form of stemmery dust is dispersed in 10 gal of tap water heated to 88° C. 0.39 lbs of cellulose pulp filler and 0.12 lbs of 1:1 exanthem gum and locust bean binding agent is added to the stemmery dust and mixed in a high shear Cowles mixer at 1160 rpm to provide a mixture while maintaining the 88° C. temperature. 0.73 lbs of diammonium hydrogen orthophosphate is added to the mixture and mixing is continued for 30 minutes. The pH is adjusted to 7.25 using 442.5 ml of ammonium hydroxide. The high shear mixing is continued for about 30 minutes to provide a tobacco material having released tobacco pectins.

The tobacco material having released tobacco pectins is sheared by passing through a Fitz Mill Comminutor having a 0.030 inch mesh screen and forming into a mass. The mass is cast at wet mass thickness of about 0.025 inches at a rate of about 2 gallons/min by extruding through the nip of a cast-sheet line head box. The cast mass is saturated with a 10 percent solution of ammonium chloride and is gradually dried at a temperature of about 100° C. to a moisture content of about 14 percent.

EXAMPLE 17

9.10 lbs of tobacco material in the form of stemmery dust is dispersed in 10 gal of tap water heated to 88° C. 0.19 lbs of cellulose pulp filler, 1.56 lbs of high fructose syrup (45% water) binding agent, 1.56 lbs of calcium sulfate filler and 0.12 lbs of 1:1 exanthem gum and locust bean binding agent are added to the stemmery dust and mixed in a high shear Cowles mixer at 1160 rpm to provide a mixture while maintaining the 88° C. temperature. 0.73 lbs of diammonium hydrogen orthophosphate is added to the mixture and mixing is continued for 30 minutes. The pH is adjusted to 6.11 using 442.5 ml of ammonium hydroxide. The high shear mixing is continued for about 30 minutes to provide a tobacco material having released tobacco pectins.

The tobacco material having released tobacco pectins is sheared by passing through a Fitz Mill Comminutor having a 0,030 inch mess screen and forming into a mass. The mass is cast at wet mass thickness of about 0,025 inches at a rate of about 2 gallons/min by extruding through the nip of a cast sheet line head box. The cast mass is saturated with a 10 percent aqueous solution of ammonium chloride and is gradually dried at a temperature of about 100° C. to a moisture content of about 14 percent.

TABLE 1

| Example | Base Wt. g/m² | Caliper μm | Tensile N/m | Stretch % | Work J/m² | Tear mN |
|---|---|---|---|---|---|---|
| 1 | 131.13 | 56.80 | 185.66 | 1.9 | 1.93 | 135 |
| 2 | 122.38 | 43.40 | 380.00 | 1.7 | 3.24 | 104 |
| 3 | 102.5 | 62.60 | 237.72 | 2.6 | 3.56 | 107 |
| 4 | 90.37 | 56.00 | 203.66 | 3.94 | 5.09 | 92 |
| 5 | 88.79 | 58.60 | 118.63 | 3.27 | 2.34 | 68 |
| 6 | 92.24 | 55.80 | 250.84 | 2.16 | 3.15 | 80 |
| 7 | 90.70 | 51.80 | 180.98 | 2.33 | 2.33 | 72 |
| 8 | 92.74 | 59.40 | 138.42 | 2.33 | 1.53 | 62 |
| 9 | 111.97 | 92.20 | 360.00 | 3.01 | 6.20 | — |
| 10 | 104.16 | 56.80 | 80.28 | 3.86 | 1.30 | 57 |
| 11 | 115.83 | 43.60 | 55.47 | 2.42 | 0.63 | 60 |
| 12 | 100.17 | 24.60 | 294.48 | 7.69 | 11.84 | 122 |
| 13 | 110.78 | 33.80 | 238.76 | 5.17 | 7.34 | 123 |
| 14 | 106.33 | 35.60 | 263.48 | 3.76 | 5.92 | 127 |
| 15 | 96.14 | 27.20 | 300.38 | 5.90 | 8.77 | 173 |

Table 1 shows that the mechanical properties of the reconstituted tobacco material provided in accordance with their present invention are comparable to conventional tobacco material and reconstituted tobacco material manufactured using conventional paper-making processes.

That which is claimed is:

1. A method of providing a tobacco material having released tobacco pectins, the method comprising the steps of:

(a) contacting tobacco material dispersed in a liquid having an aqueous character with a humectant or binding agent or both under high shear mixing conditions at a temperature of at least about 35° C. to provide a mixture and (b) contacting the mixture of step (a) with a pectin release agent while maintaining the high shear mixing conditions and a temperature of at least about 35° C. to provide a tobacco material having released tobacco pectins.

2. A method according to claim 1 wherein the tobacco material having released tobacco pectins is formed into a sheet-like shape.

3. A method according to claim 1 or 2 wherein step (b) is conducted at a pH of about 5 to about 9.

4. A method according to claim 1 or 2 wherein step (a) comprises contacting the tobacco material with a binding agent including a reticulated bacterial cellulose.

5. A method according to claim 1 or 2 wherein step (a) comprises contacting the tobacco material with a binding agent including a high solids sugar.

6. A method according to claim 1 or 2 wherein the pectin release agent includes a water soluble phosphate salt selected from the group consisting of diammonium hydrogen orthophosphate, ammonium dihydrogen orthophosphate and potassium dihydrogen phosphate.

7. The method according to claim 1 or 2 wherein the tobacco material having released tobacco pectins is dried to a moisture content of about 10 to about 15 weight percent.

8. The method according to claim 1 or 2 wherein step (a) comprises contacting the tobacco material with a humectant including a polyhyrdic alcohol.

9. The method according to claim 1 or 2 wherein the liquid having an aqueous character is greater than 90 percent water.

10. A method of providing a tobacco material having released tobacco pectins, the method comprising the steps of:

(a) contacting tobacco material dispersed in a liquid having an aqueous character with a humectant or binding agent or both under high shear mixing conditions at a temperature of at least about 35° C. to provide a mixture and (b) contacting the mixture of step (a) with a pectin release agent while maintaining the high shear mixing conditions and a temperature of at least about 35° C. to provide a tobacco material having released tobacco pectins;

(c) forming the tobacco material having released tobacco pectins of step (b) into a predetermined shape; and (d) reducing the moisture content of the formed tobacco material provided in step (c) to cause the released tobacco pectins to undergo crosslinking.

11. A method according to claim 10 wherein step (b) is conducted at a pH of about 5 to about 9.

12. A method according to claim 10 wherein step (a) comprises contacting the tobacco material with a binding agent including a reticulated bacterial cellulose.

13. A method according to claim 10 wherein step (a) comprises contacting the tobacco material with a binding agent including a high solids sugar.

14. A method according to claim 10 wherein the pectin release agent includes a water soluble phosphate salt selected from the group consisting of diammonium hydrogen orthophosphate, ammonium dihydrogen orthophosphate and potassium dihydrogen phosphate.

15. The method according to claim 10 wherein the tobacco material having released tobacco pectins is dried to a moisture content of about 10 to about 15 weight percent.

16. The method according to claim 10 wherein step (a) comprises contacting the tobacco material with a humectant including a polyhydric alcohol.

17. The method according to claim 10 including contacting the crosslinked formed tobacco material of step (d) with an amount of water soluble alkaline earth metal ions sufficient to cause the released tobacco pectins to undergo further crosslinking.

18. A method of providing a reconstituted tobacco material, the method comprising the steps of:

(a) contacting tobacco material dispersed in a liquid having an aqueous character with a humectant under high shear mixing conditions at a temperature of at least about 35° C. to provide a mixture;

(b) contacting the mixture of step (a) with a pectin release agent at a pH of about 5 to about 9, while maintaining the high shear mixing conditions to provide a tobacco material having released tobacco pectins;

(c) forming the tobacco material having released tobacco pectins of step (b) into a predetermined shape; and (d) subjecting the tobacco material provided in step (c) to conditions sufficient to cause the released tobacco pectins to undergo crosslinking.

19. A method according to claim 18 wherein the pectin release agent includes a water soluble phosphate salt selected from the group consisting of diammonium hydrogen orthophosphate, ammonium dihydrogen orthophosphate and potassium dihydrogen phosphate.

20. The method according to claim 18 wherein the conditions sufficient to use the released tobacco pectins to undergo crosslinking includes drying the formed tobacco material to a moisture content of about 10 to about 15 weight percent.

21. The method according to claim 18 wherein the humectant includes a polyhydric alcohol.

22. The method according to claim 18 wherein the conditions sufficient to cause the released tobacco pectins to undergo crosslinking includes contacting the tobacco material provided in step (c) with a crosslinking agent capable of providing alkaline earth metal ions.

23. The method according to claim 18 wherein the liquid having an aqueous character is greater than 90 percent water.

24. A method of providing a reconstituted tobacco material, the method comprising the steps of:

(a) contacting tobacco material dispersed in a liquid having an aqueous character with a binding agent under high shear mixing conditions at a temperature of at least about 35° C. to provide a mixture;

(b) contacting the mixture of step (a) with a pectin release agent at a pH of about 5 to about 9, while maintaining the high shear mixing conditions to provide a tobacco material having released tobacco pectins;

(c) forming the tobacco material having released tobacco pectins of step (b) into a predetermined shape; and (d) subjecting the formed tobacco material provided in step (c) to conditions sufficient to cause the released tobacco pectins to undergo crosslinking.

25. A method according to claim 24 wherein the pectin release agent includes a water soluble phosphate salt selected from the group consisting of diammonium hydrogen orthophosphate, ammonium dihydrogen orthophosphate and potassium dihydrogen phosphate.

26. The method according to claim 24 wherein the tobacco material having released tobacco pectins is dried to a moisture content of about 10 to about 15 weight percent.

27. The method according to claim 24 wherein the binding agent includes a reticulated bacterial cellulose.

28. A method according to claim 24 wherein the binding agent includes a high solids sugar.

29. The method according to claim 24 wherein the conditions sufficient to cause the released tobacco pectins to undergo crosslinking includes contacting the tobacco material provided in step (d) with a crosslinking agent capable of providing alkaline earth metal ions.

30. The method according to claim 24 wherein the liquid having an aqueous character is greater than 90 percent water.

31. A method of providing a reconstituted tobacco material, the method comprising the steps of:

(a) contacting tobacco material dispersed in a liquid having an aqueous character with a binding agent including reticulated bacterial cellulose under high shear mixing conditions at a temperature of at least about 35° C. to provide a tobacco material having released tobacco pectins;

(b) forming the tobacco material having released tobacco pectins of step (a) into a predetermined shape; and (c) subjecting the tobacco material provided in step (b) to conditions sufficient to cause the released tobacco pectins to undergo crosslinking.

32. The method according to claim 31 wherein the conditions sufficient to cause the released tobacco pectins to undergo crosslinking includes contacting the tobacco material provided in step (c) with a crosslinking agent capable of providing alkaline earth metal ions.

33. The method according to claim 31 wherein the liquid having an aqueous character is greater than 90 percent water.

* * * * *